US005415409A

United States Patent [19]

Hellmann

[11] Patent Number: 5,415,409

[45] Date of Patent: May 16, 1995

[54] DEVICE FOR AUTOMATICALLY TEEING UP GOLF BALLS

[76] Inventor: Bill W. Hellmann, 1973 St. Germain, St. Laurent, Quebec, Canada, H4L 3S9

[21] Appl. No.: 179,014

[22] Filed: Jan. 7, 1994

[51] Int. Cl.[6] ..... A63B 57/00

[52] U.S. Cl. ..... 273/201

[58] Field of Search ..... 273/201

[56] References Cited

U.S. PATENT DOCUMENTS

| | | | |
|---|---|---|---|
| 2,520,952 | 9/1950 | Mozel | 273/201 X |
| 2,525,823 | 10/1950 | Mozel | 273/201 |
| 3,423,097 | 1/1969 | Fry | 273/201 |
| 4,017,087 | 4/1977 | Bruno | 273/201 |
| 4,146,232 | 3/1979 | Stone | 273/201 |
| 4,198,054 | 4/1980 | Stone | 273/201 |
| 4,265,453 | 5/1981 | Loof | 273/201 |
| 4,355,811 | 10/1982 | Williams, Sr. | 273/201 |
| 4,541,632 | 9/1985 | Tillery | 273/201 |
| 4,662,641 | 5/1987 | Peyret, Jr. | 273/201 X |
| 4,817,955 | 4/1989 | Hickson et al. | 273/201 |
| 4,957,296 | 9/1990 | Turnidge et al. | 273/201 |
| 5,078,401 | 1/1992 | Fehrenbach et al. | 273/201 |
| 5,131,661 | 7/1992 | Jorgensen | 273/201 |

*Primary Examiner*—William H. Grieb

*Attorney, Agent, or Firm*—Shlesinger Arkwright & Garvey

[57] ABSTRACT

An automatic teeing device positions a golf ball on a tee. The device provides all the mechanism below a platform so that a golf ball can be hit from the tee by either righthand or lefthand hitters. The device comprises a platform having a golf tee thereon and a golf ball delivery aperture in the platform adjacent the tee. A golf ball gripping device allows a golf ball to be gripped and released and a feed chute feeds golf balls to a loading position under the platform. A pivot arm driven by a rotating mechanism has the ball gripper at one end and pivots a ball from the loading position adjacent the feed chute to a deposit position above the tee.

12 Claims, 2 Drawing Sheets

DEVICE FOR AUTOMATICALLY TEEING UP GOLF BALLS

TECHNICAL FIELD

The present invention relates to an automatic teeing device and more specifically to a device that places golf balls on a golf tee suitable for driving ranges and the like.

BACKGROUND ART

There are many devices that have been suggested for use in golf driving ranges wherein golf balls are automatically teed up on a platform. Some of these devices include hoppers and the like located beside a tee which have a mechanism to transfer a golf ball directly to a tee, generally by a pivoting arm that deposits a ball on the tee. These devices, while being satisfactory, have certain problems, particularly as golfers are either lefthanded or righthanded, thus a hopper and transfer device beside a tee can generally only be used for either a righthanded or a lefthanded golfer.

There are other devices which incorporate a mechanism below the platform that the golfer stands on. In many of these cases, the tee itself moves downwards, and a ball placed on the tee prior to the tee moving upwards to the desired position. One example of such a device is shown by Fehrenbach et al in U.S. Pat. No. 5,078,401.

DISCLOSURE OF INVENTION

It is an aim of the present invention to provide a device for teeing up a ball automatically wherein the mechanism is positioned below the platform that the golfer stands on and wherein the tee itself does not have to be moved. Thus, the platform with the tee thereon may be used by lefthanded or righthanded golfers. Furthermore, an adjustable height tee may be provided.

The present invention provides a device for automatically teeing up golf balls comprising: a platform having a golf tee thereon and a golf ball delivery aperture in the platform adjacent the golf tee; a ball gripper having means to grip a golf ball and means to release the golf ball; a feed chute to feed golf balls individually to a loading position under the platform; a pivot arm attached to the ball gripper, pivoted about an axis below the platform, the pivot arm having a pivotal movement wherein the ball gripper moves from the loading position to pass through the delivery aperture to a deposit position above the golf tee; drive means to move the ball gripper from the loading position to the deposit position and back to the loading position, and an operator means to activate the drive means, grip a golf ball with the ball gripper in the loading position, release a golf ball from the ball gripper at the deposit position, and return the ball gripper to the loading position.

The present invention also provides a method of automatically teeing up golf balls comprising the steps of: gripping a golf ball at a loading position with a ball gripper beneath a platform having a golf tee thereon; pivoting the ball gripper, retaining a golf ball, upwards through a golf ball delivery aperture in the platform adjacent the golf tee to a deposit position above the golf tee; releasing the ball gripper to deposit the golf ball on the golf tee, and pivoting the ball gripper downwards through the aperture to the loading position in readiness to grip another golf ball.

BRIEF DESCRIPTION OF DRAWINGS

In drawings which illustrate embodiments of the present invention.

BEST MODE FOR CARRYING OUT THE INVENTION

Figure 1:
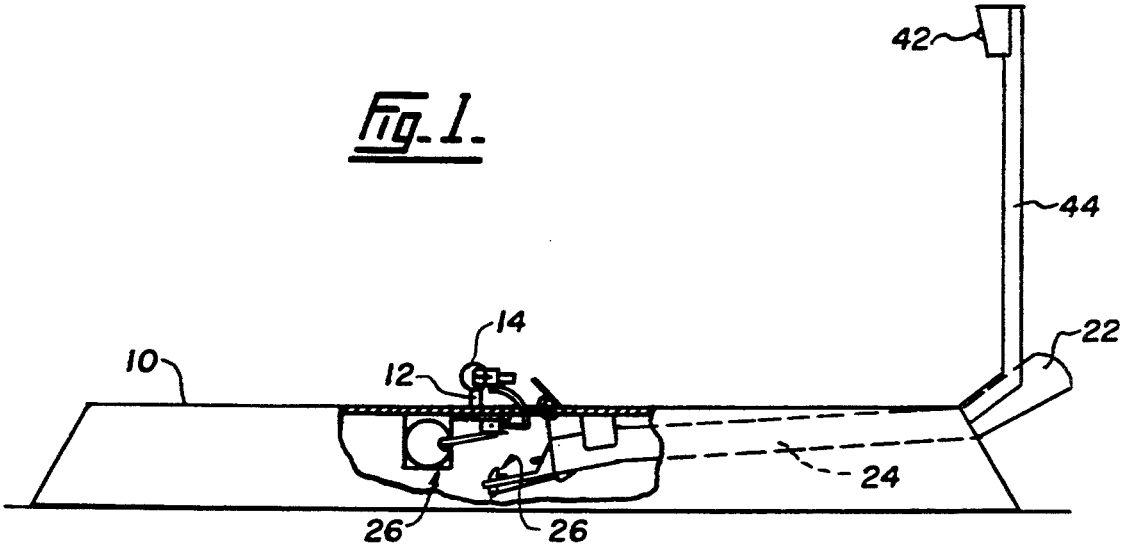
FIG. 1 is a side elevational view partly in section, showing a platform having a device for automatically teeing up golf balls according to the present invention.

A platform 10 is shown in FIG. 1 which may have artificial grass or carpet on the top surface. A golf tee 12 is positioned approximately in the center of the platform 10 thus allowing a golf ball 14 placed upon the tee 12 to be hit from either the lefthand side or the righthand side. A ball teeing up device 20 is located under the platform 10. A ball hopper 22 at one side of the platform 10 is provided for placing a quantity of balls therein, the balls feed through a chute 24 individually to a loading position 26. The chute 24 slopes downwards so that a golf ball 14 picked up from the loading position 26 and placed upon the tee is replaced by another ball which is allowed to roll into the loading position 26.

Figure 2:
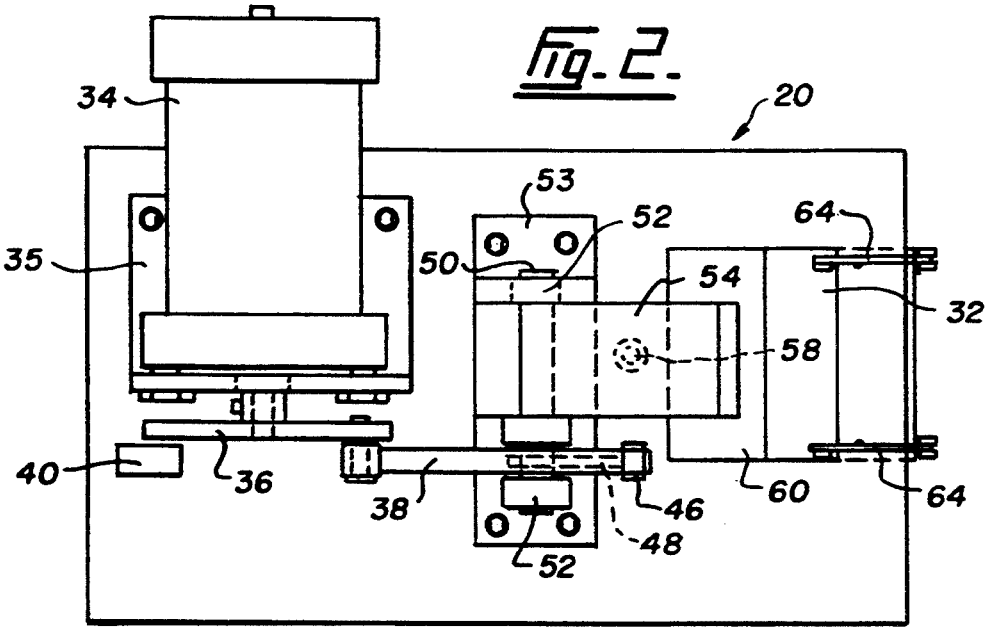
FIG. 2 is a plan view showing the underside of the device for automatically teeing up golf balls according to the present invention.
Figure 3:
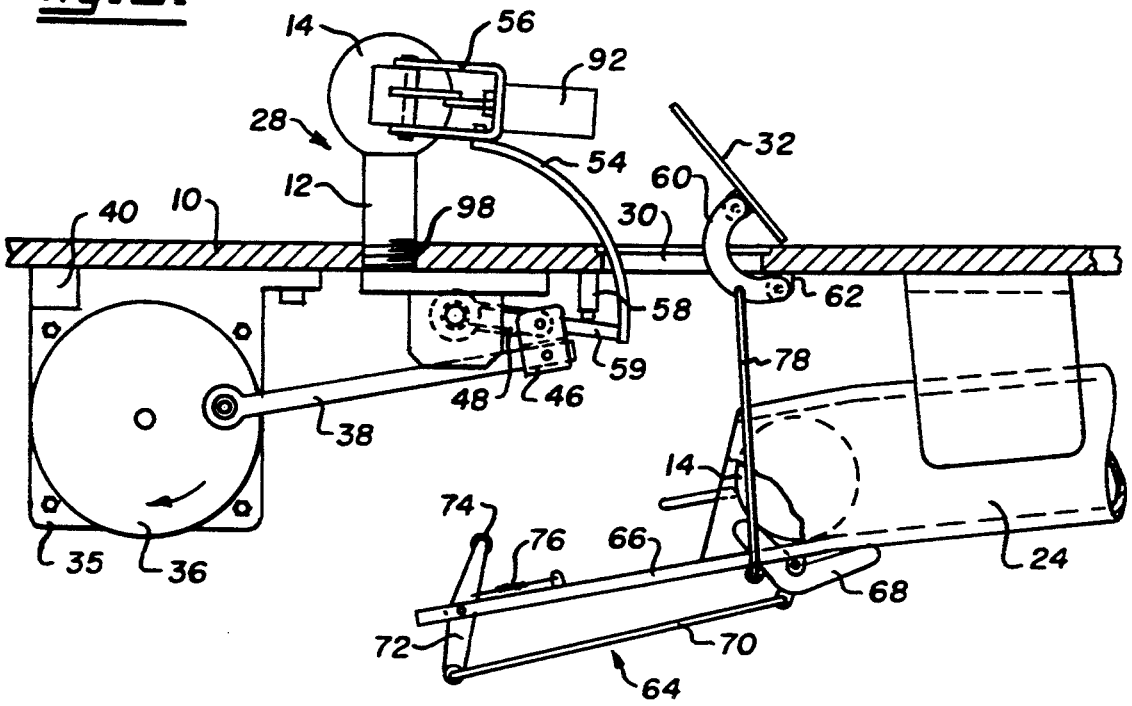
FIG. 3 is a sectional elevational view showing the device for automatically teeing up golf balls as shown in FIG. 2 with the ball gripper in the deposit position.
Figure 4:
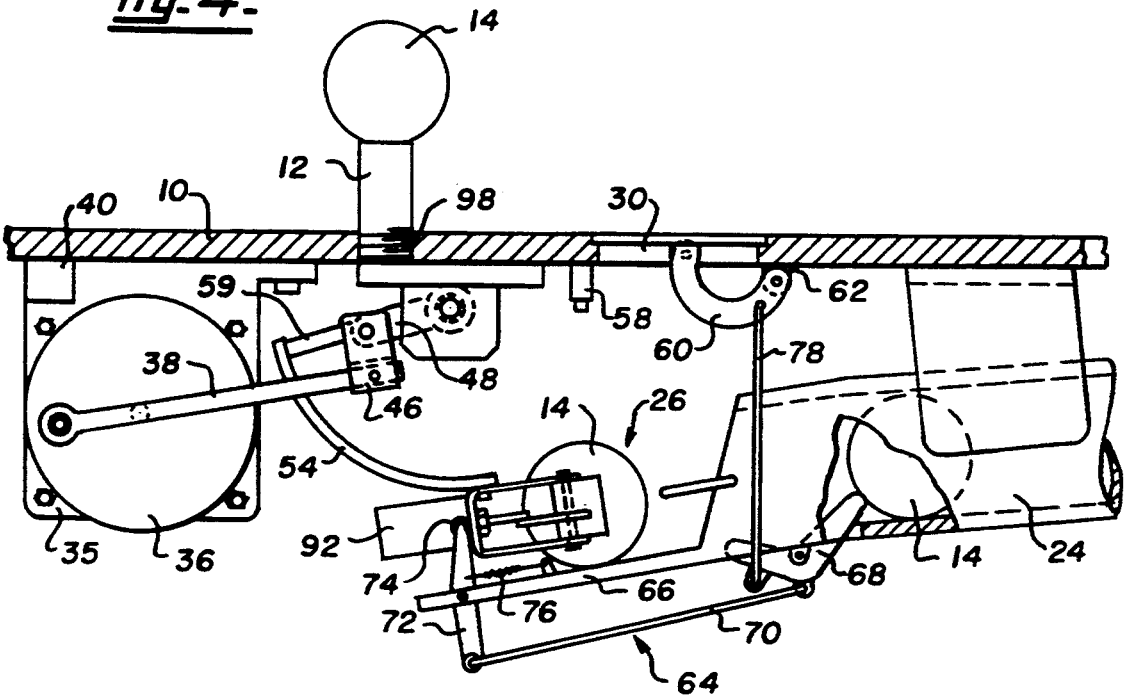
FIG. 4 is a sectional elevational view, similar to FIG. 3, with the ball gripper in the loading position.

Details of the ball teeing up device 20 are shown in FIGS. 2 to 5 wherein a golf ball 14 is moved from the loading position 26 at the bottom of chute 24, as shown in FIG. 4, to a deposit position 28 directly above the tee 12, as shown in FIG. 3. A ball delivery aperture 30 is provided in the platform 10 adjacent the tee 12. The aperture 30 has a cover plate 32 which is pivoted to open when a ball is deposited onto the tee.

As shown in FIG. 2, a motor 34 is mounted on a bracket 35 underneath the platform 10 and drives a disc 36 to which is connected a crank arm 38. A microswitch 40 shown in FIGS. 2, 3 and 4, is provided to ensure that the disc 36 makes one complete revolution for the teeing up operation from the loading position as shown in FIG. 4 through the deposit position shown in FIG. 3 and back to the loading position shown in FIG. 4. The teeing up operation is started by a pushbutton 42 shown in FIG. 1 as being mounted at a convenient height on a pedestal 44. Whereas the pushbutton 42 is illustrated on a pedestal 44, it would be obvious for the pushbutton 42 for instance to be a foot button in the platform 10 or some other suitable arrangement, such as an automatic teeing up arrangement which is activated every time a ball is driven off the tee 12.

The crank arm 38 has a connection bracket 46 connected to a control arm 48 which rotates about a shaft 50 in bearings 52 mounted on a bracket 53 to the underside of the platform 10. The shaft 50 is keyed to a quadrant shaped pivot arm 54 which in turn is attached to a ball gripper 56 as shown in more detail in FIG. 5. The quadrant shaped pivot arm 54 has a cutout so that it moves the ball gripper 56 from a loading position 26 as shown in FIG. 4 up to a deposit position 28 as shown in FIG. 3. The aperture 30 is of sufficient size to permit the pivot arm 54 and ball gripper 56 to pass therethrough. A microswitch 58 is positioned on the underside of the platform 10 at a location where it is contacted by a radial arm portion 59 of the pivot arm 54 when the ball gripper 56 is in the deposit position 28.

The length of the crank arm 38, the diameter of the disc 36 and the length of the control arm 48 are such that a single rotation of the disc 36 moves the pivot arm 54 so the ball gripper 56 moves from the loading position 26 up to the deposit position 28 and back down to the loading position 26.

Two C-shaped hinges 60 are provided for the cover plate 32, connected to brackets 62 on the underside of the platform 10. A preloading mechanism 64 is attached to the end of the ball chute 24 and has two guides 66 for a ball to roll on extending from the end of the chute 24. A release cam 68, having two arms is pivoted directly below the end of the chute and has a link arm 70 which extends to one end of a trigger lever 72, pivoted at its center to the end of the two guides 66 and having rollers 74 at the other end to be contacted by the ball gripper 56. The trigger lever 72 has a spring 76 which acts to pull the trigger lever 72 forward into the position shown in FIG. 3 when the ball gripper has moved from the loading position 26. When in this position, the link arm 70 pivots the release cam 68 so that a ball from chute 24 rolls into the cam 68 between the two arms. At the same time two cover plate links 78, joined to the release cam 68 and connected to the C-shaped hinges 60, open the cover plate 32 so the aperture 30 is open and ready for the ball gripper 56 holding a golf ball 14 to pass therethrough.

When the ball gripper 56 has deposited a ball 14 on the tee 12, it returns to the loading position 26 and pushes against the rollers 74 of the trigger lever 72 so the lever is moved back. This pivots the release cam 68, allowing the ball in the cam to roll into the loading position 26 to be gripped by the ball gripper 56. One arm of the release cam 68 prevents the next ball in the chute 24 from rolling into the cam, as seen in FIG. 4, and at the same time, the cover plate links 78 move downwards closing the cover plate 32.

Figure 5:
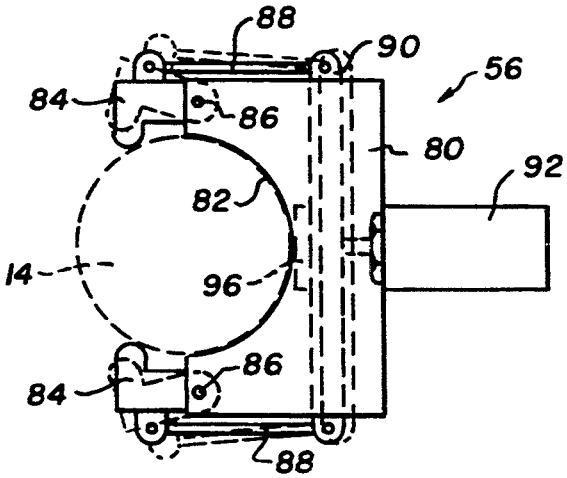
FIG. 5 is a top plan view showing the ball gripper of FIGS. 3 and 4.

As shown in FIG. 5, he ball gripper 56 has a housing 80 with a cutout 82 having the exact radius of a golf ball 14. The housing 80 is shown having a thickness equivalent to about one-third the diameter of a golf ball. Gripper fingers 84 are provided on each side of the housing 80. The fingers 84 have ball gripping surfaces and are connected to pivot pins 86 in the housing 80 and have link arms 88 connected to a cross member 90 which in turn is activated by an electric solenoid 92. When the solenoid 92 is deactivated, the fingers 84 are open and a golf ball 14 is not gripped. When the solenoid 92 is activated, then the fingers 84 close and grip a golf ball 14.

When the ball gripper 56 returns to the loading position 26 as shown in FIG. 4, the gripping fingers 84 are open. The release cam 68 releases a golf ball to roll into the loading position 26 between the fingers 84 of the ball gripper 56. A photocell 96 in the cutout 82 of the ball gripper 56 does not allow the solenoid 92 to be activated to close the gripping fingers 84 unless there is a golf ball in the ball gripper 56.

In operation when the pushbutton 42 is pressed to deposit a golf ball 14 onto the tee 12, the photocell 96 checks that there is a golf ball 14 in the ball gripper 56, and if a ball is there, the fingers 84 close. The motor 34 commences to rotate the disc 36 and the crank arm 36 commences to pivot the pivot arm 54 so that the ball gripper 56 moves away from the loading position 26. As the ball gripper 56 leaves the loading position 26, the spring 76 pulls the trigger lever 72 forward, this causes the cover plate 32 to open and a golf ball to roll into the release cam 68 between the two arms. The ball gripper 56 pivots to the deposit position 28, as shown in FIG. 3, the radial arm portion 59 of the pivot arm 54 activates the microswitch 58 which in turn deactivates the solenoid 92 of the ball gripper 56 so the fingers 84 open and the golf ball 14 is deposited onto the tee 12. The disc 36 has rotated through 180° and as it continues to rotate for a further 180°, the reverse action occurs and the ball gripper 56 pivots downwards returning to the loading position 26 where it moves the trigger lever 72, thus closing the cover plate 32 and releasing the ball in the release cam 68 to roll into the loading position 26. The microswitch 40 stops the disc 36 rotating after it has rotated through exactly 360° and a golf ball has rolled into the loading position 26 ready to be gripped by the ball gripper 56 for the next cycle.

Every time the pushbutton 42 is depressed a cycle occurs wherein a golf ball is moved from the loading position 26 to the deposit position 28 and deposited on the tee 12. The ball gripper 56 then returns to the loading position 26. The tee 12 as shown is preferably made of a rubber or plastic material that is flexible so that it cannot be damaged when struck by a golf club. Furthermore, the tee 12 has a threaded bottom portion which fits into a threaded hole 98 in the platform 10 and this permits the height of the tee to be adjusted for each individual golfer. A golf ball is deposited at a sufficient height above the tee that it always drops and is supported on the tee, regardless of tee height.

When there are no more balls in the chute 24, the photocell 96 does not see a ball in the ball gripper 56 and therefore the gripping fingers 84 do not close. The ball teeing up device will not operate until more balls are placed in the hopper 22. When the cover plate 32 is closed, the mechanism is protected and only the golf tee 12 is visible on the platform.

As stated, the pushbutton 42 for operating the loading device and the hopper 22 for the golf balls are placed at a sufficient distance away from the tee 12 to permit a golfer to stand and address the ball from either the left or the right side of the tee. In another embodiment where space is at a premium, the ball teeing up device and tee are positioned so that a golf ball can only be hit from one side and this reduces the width of the platform 10. The platform 10 may then be made to be rotated so that the golfer can hit a ball when the tee is positioned either to the left or to the right of the platform.

Other changes may be made to the embodiments shown herein without departing from the scope of the present invention which is limited only by the following claims.

The embodiments of the present invention in which an exclusive property or privilege is claimed are defined as follows:

1. A device for automatically teeing up golf balls comprising:

a platform having a golf tee thereon and a golf ball delivery aperture in the platform adjacent the golf tee;

a ball gripper having gripping fingers on either side to grip a golf ball and means to release the golf ball;

a feed chute to feed golf balls individually to a loading position under the platform;

a pivot arm attached to the ball gripper, pivoted about an axis below the platform, the pivot arm having a pivotal movement wherein the ball gripper moves from the loading position to pass through the delivery aperture to a deposit position above the golf tee;

a crank arm rotatable through 360° to move the ball gripper from the loading position to the deposit position and to the loading position again;

drive motor to rotate the crank arm from the loading position through 180° to the deposit position and through a further 180° to the loading position again, and an operator means to activate the crank arm, grip a golf ball with the ball gripper in the loading position, release a golf ball from the ball gripper at the deposit position and return the ball gripper to the loading position.

2. The devise for automatically teeing up golf balls according to claim 1 including a preloading mechanism activated when the ball gripper returns to the loading position, the preloading mechanism permitting a ball to feed from the feed chute to the loading position.

3. The device for automatically teeing up golf balls according to claim 2 including a cover over the golf ball delivery aperture, the cover having a cover pivot link connected to the preloading mechanism so that the cover is opened as the ball gripper moves away from the loading position, and the cover is closed as the ball gripper returns to the loading position.

4. The device for automatically teeing up golf balls according to claim 1 wherein the golf tee has an adjustable height.

5. The device for automatically teeing up golf balls according to claim 1 wherein the operator means is a pushbutton separate from the device.

6. The device for automatically teeing up golf balls according to claim 1 wherein the gripping fingers are actuated by a solenoid.

7. The device for automatically teeing up golf balls according to claim 6 wherein the ball gripper has a photocell to signal whether a golf ball is in position for the gripping fingers to grip a golf ball.

8. The device for automatically teeing up golf balls according to claim 6 including a microswitch activated by the pivot arm to open the gripping fingers so the golf ball is released when the ball gripper is in the deposit position.

9. A method of automatically teeing up golf balls comprising the steps of:

gripping a golf ball at a loading position with gripping fingers on either side of the golf ball, the loading position being beneath a platform having a golf tee thereon;

pivoting the gripping fingers, retaining a golf ball, upwards through a golf ball delivery aperture in the platform adjacent the golf tee, to a deposit position above the golf tee, the pivoting occurring by pivot linkage means powered by a motor to rotate through 180° from the loading position to the deposit position;

releasing the gripping fingers to deposit the golf ball on the golf tee, and pivoting the gripping fingers downwards through the aperture by the pivot linkage means rotating through a further 180° to the loading position in readiness to grip another golf ball.

10. The method of automatically teeing up golf balls according to claim 9 including the step of removing a cover over the aperture for the gripping fingers to pass through the aperture to the deposit position, and replacing the cover over the aperture after the gripping fingers have pivoted downwards to the loading position.

11. The method of automatically teeing up golf balls according to claim 9 including the step of feeding a ball from a feed chute to the loading position after the gripping fingers have pivoted downwards to the loading position.

12. The method of automatically teeing up golf balls according to claim 9 including the step of detecting whether a golf ball is in the loading position before commencing to pivot the gripping fingers to the deposit position.

* * * * *